US009510729B2

(12) United States Patent
Fey et al.

(10) Patent No.: US 9,510,729 B2
(45) Date of Patent: Dec. 6, 2016

(54) DISHWASHER WITH AT LEAST ONE RECEIVING STRUCTURE FOR ITEMS TO BE WASHED THAT IS PROVIDED WITH ARRANGEMENT DIRECTIONS

(75) Inventors: Janina Fey, München (DE); Thomas Ott, Neubiberg (DE); Martin Reichhuber, München (DE); Nico Zendel, München (DE)

(73) Assignee: BSH Hausgeräte Gmbh, Munich (DE)

( * ) Notice: Subject to any disclaimer, the term of this patent is extended or adjusted under 35 U.S.C. 154(b) by 215 days.

(21) Appl. No.: 14/236,346

(22) PCT Filed: Jul. 25, 2012

(86) PCT No.: PCT/EP2012/064561
§ 371 (c)(1),
(2), (4) Date: Jan. 31, 2014

(87) PCT Pub. No.: WO2013/020811
PCT Pub. Date: Feb. 14, 2013

(65) Prior Publication Data

US 2014/0197719 A1 Jul. 17, 2014

(30) Foreign Application Priority Data

Aug. 11, 2011 (DE) ..... 10 2011 080 842

(51) Int. Cl.
*A47L 15/50* (2006.01)

(52) U.S. Cl.
CPC ..... *A47L 15/50* (2013.01); *A47L 15/503* (2013.01); *A47L 15/504* (2013.01); *A47L 15/505* (2013.01);
(Continued)

(58) Field of Classification Search
CPC ..... A47L 15/50; A47L 15/502; A47L 15/503; A47L 15/504; A47L 15/505; A47L 15/506; A47L 15/507; A47L 15/508
(Continued)

(56) References Cited

U.S. PATENT DOCUMENTS

2005/0109378 A1 5/2005 Landsiedel et al.
2006/0065666 A1 3/2006 Dunn et al.
(Continued)

FOREIGN PATENT DOCUMENTS

DE 10322096 A1 12/2004
DE 102006056914 A1 6/2008
(Continued)

OTHER PUBLICATIONS

International Search Report PCT/EP2012/064561 dated Oct. 17, 2012.
(Continued)

*Primary Examiner* — Michael Barr
*Assistant Examiner* — Levon J Shahinian
(74) *Attorney, Agent, or Firm* — Michael E. Tschupp; Andre Pallapies

(57) ABSTRACT

A dishwasher for cleaning an item to be washed includes at least one receiving structure which is configured to hold the item to be washed. Disposed on the at least one receiving structure is at least one arrangement direction for indicating a position where the item to be washed is to be placed in the at least one receiving structure.

15 Claims, 6 Drawing Sheets

(52) U.S. Cl.
CPC ..... *A47L 15/506* (2013.01); *A47L 15/507* (2013.01); *A47L 15/508* (2013.01); *A47L 15/502* (2013.01)

(58) Field of Classification Search
USPC ..... 134/56 D, 57 D, 58 D; 211/41.8, 41.9; 220/488
See application file for complete search history.

(56) References Cited

U.S. PATENT DOCUMENTS

| | | | | |
|---|---|---|---|---|
| 2006/0219271 | A1 | 10/2006 | Feddema et al. | |
| 2006/0237053 | A1* | 10/2006 | Bengston | A47L 15/502 134/58 D |
| 2006/0250058 | A1 | 11/2006 | Stevens et al. | |
| 2007/0124974 | A1* | 6/2007 | Lanier | G09F 3/06 40/658 |
| 2007/0261724 | A1* | 11/2007 | Kemper | A47L 15/505 134/84 |

FOREIGN PATENT DOCUMENTS

| | | | |
|---|---|---|---|
| EP | 1683465 | B1 | 9/2009 |
| EP | 2330050 | A1 | 6/2011 |
| EP | 2554097 | A2 | 2/2013 |
| WO | 2007127819 | A2 | 11/2007 |

OTHER PUBLICATIONS

Report of Examination DE 10 2011 080 842.6 dated Jun. 21, 2012.
Report of Examination DE 10 2011 080 842.6 dated Sep. 11, 2013.

* cited by examiner

DISHWASHER WITH AT LEAST ONE RECEIVING STRUCTURE FOR ITEMS TO BE WASHED THAT IS PROVIDED WITH ARRANGEMENT DIRECTIONS

BACKGROUND OF THE INVENTION

The invention relates to a dishwasher for cleaning tableware, flatware or similar items to be cleaned, the dishwasher comprising at least one receiving structure, in particular a drawer that can be displaced in a forward direction for loading and unloading purposes, provided for the holding and/or positioning of items to be washed.

It is known that flatware drawers in particular can be provided in the wash containers of dishwashers as individual units that can be displaced in a forward direction, allowing an essentially horizontal holding and/or positioning of flatware items and other, preferably small, items to be washed, so that flatware items for example no longer have to stand upright in a basket that can be lifted up using a carrying handle. Such flatware drawers are frequently disposed as a third unit above two tableware racks below, so only a very small amount of space remains in a heightwise direction for the tableware racks and/or primarily the flatware drawer.

Effective filling of the flatware drawer is therefore important, in order to prevent collision of the items to be washed contained therein with the upper edge or top wall of the enclosing wash container or with one or more nozzles emitting wash liquor and positioned for example on the top wall of the wash container as the flatware drawer is moved in and out and to allow the optimum application of wash liquid (in the following also referred to as wash liquor) from above and/or below, thereby allowing efficient cleaning of the items to be washed held therein. The most effective filling possible with items to be washed is also similarly desirable for the receiving structures of tableware racks in order to allow the respective tableware rack to be pulled out of the wash container with as little collision as possible, in other words unimpeded, and/or to allow the respective tableware rack to be pushed into the wash container without collision and at the same time to allow an adequate passage of wash liquid through the receiving structures of the tableware racks to the items to be cleaned. As the user often becomes confused when faced with a receiving structure with a grid configuration and base regions at different heights and/or differing structure zones that are provided in particular for specific items to be washed, such items to be washed are often not introduced optimally so that for example in the case of a spoon positioned the wrong way round in a flatware drawer, the handle is cleaned very thoroughly but the much more problematic actual spoon region is not. The same is true when items to be washed, for example large plates, small plates, cups, glasses, etc., are not positioned in the correct position and/or with the correct orientation in the zones or regions of the receiving structures of tableware racks provided specifically for them.

BRIEF SUMMARY OF THE INVENTION

The problem underlying the invention is that of facilitating operation for the user.

With the invention a dishwasher is created, which facilitates optimized filling of a receiving structure for the positioning and/or holding of items to be cleaned, in particular in the case of a flatware drawer of flatware items and/or other small items to be washed, in that one or more arrangement directions, in particular arrangement direction elements, for items to be washed that are to be held and/or positioned there are disposed for visualization on the receiving structure. A user can therefore perceive these one or more arrangement directions visually at any time when the receiving structure is opened and ready for filling and does not then require instructions for use or the like for the optimized positioning and/or holding, in particular locating and/or orienting, of the items to be washed. This provides simple loading assistance for the user of a dishwasher when introducing, in particular sorting, different items to be washed, in particular flatware items or other small items to be washed, into positioning and/or holding regions of the receiving structure provided with a specific location and/or orientation for them.

If the one or more arrangement directions advantageously comprise pictorial symbols or icons of the items to be washed that are to be held and/or positioned respectively there, in the case of a flatware drawer in particular different flatware items, such as spoons, forks, knives, teaspoons, pastry forks, ladles, etc., of a place setting, and/or other small items to be washed such as for example espresso cups, the user knows what type of items to be washed should be held and/positioned in the respective place, i.e. target location, and/or with what target orientation the respective item to be washed should be oriented in relation to the respective target holding and/or positioning place. Such an individual identification of positioning and/or holding regions of the receiving structure for the specific assignment of different types or categories of items to be washed, in particular flatware items, for example knives, forks, spoons, ladles, etc., as well as other types of item to be washed, for example espresso or mocha cups, and/or the indication of the respectively recommended, optimum orientation of the items to be washed, is furthermore international and does not require the user to have any knowledge of a specific language. The manufacturer therefore does not have to provide different textual identifications for different language areas. The symbols can in particular contain miniatures of the items to be washed to be introduced in each instance in a space-saving and visually discreet manner.

The arrangement directions particularly favorably show a target orientation for items to be washed that are to be positioned and/or held in the respective receiving structure, so that an incorrect orientation, as described above, of an item to be washed, in particular a flatware item, for example a spoon or ladle, with negative consequences for the cleaning result, can be avoided.

If an arrangement direction contains a two-dimensional or three-dimensional image of a flatware item, for example a spoon, fork, knife, and/or a ladle, and/or a tableware item, and/or another item to be washed, it can in particular also be a fixed component that is preferably incorporated during the production of the receiving structure, without having to undergo a further processing step at a later stage. This is particularly expedient if the respective receiving structure is made of a plastic material or its structural components are coated with a plastic material. The arrangement direction elements can then also be molded, in particular injection molded, in the form of plastic elements, in particular in the same operation, in a simple manner on the structural components of the receiving structure. The miniaturized two-dimensional or three-dimensional configuration of the one or more receiving structures, in that they correspond essentially to the geometric forms of items to be washed that are to be introduced into the receiving structure, in the case of a flatware drawer in particular of flatware items such as for example spoons, forks, knives, ladles, etc., or other small items to be washed, for example mocha cups, allows target locations and/or target orientations for items to be washed that are to be introduced into the receiving structure, in particular into a flatware drawer, to be visualized in a more effective manner for the respective user.

In particular it can be expedient if the one or more arrangement directions are assigned at least partially to one or more, in particular perforated, base regions of the receiving structure and are visible from above. For this purpose they are expediently located roughly in the plane of a base region of the receiving structure, in particular of a flatware drawer.

In particular it can be advantageous if the one or more arrangement directions are positioned, in particular molded, as identification elements, in particular pictorial symbol elements, in each instance on the upper face of webs of the grid base of the receiving structure. The molding of such arrangement directions on an upper face on the receiving structure can be achieved in a simple manner from a production point of view. It also means that they are clearly visible to a user when viewed from above. Also liquid can reach them easily—particularly from above—and flow away from them again so they are cleaned and dried in a reliable manner.

If the arrangement direction elements have in particular three-dimensional geometric forms, their plasticity is improved compared with a two-dimensional configuration, thereby ensuring better visualization.

The one or more arrangement directions here are in particular assigned to the base region of the receiving structure in such a manner that they do not extend beyond its thickness in a vertical direction. The arrangement directions themselves do not therefore take away any space that could be used for items to be washed.

The one or more arrangement directions here can be configured at least partially as images removed (for example stamped or cut out) from flat base regions of the receiving structure; in other words they are formed by "negative forms". The stamps or cutouts here are each typically a few millimeters wide so that wash liquor can pass through them—in particular from bottom to top (and/or conversely from top to bottom) and the cleaning operation is thus not impeded by the symbols. The images taken out, in other words openings in the form of images of the different types of items to be washed, preferably flatware items, indicate or identify positioning locations and/or target orientations assigned specifically to the different items to be washed that are to be positioned and/or held, in the base of the receiving structure. Liquid can pass freely from top to bottom and/or from bottom to top through the image symbols configured in the form of openings or gaps, in other words holes, in particular being sprayed by means of one or more spray facilities, for example from a lower spray arm and a top spray.

Alternatively the one or more arrangement directions can optionally be configured at least partially as plastic symbols, in particular two-dimensional or three-dimensional geometric forms, molded, in particular injection molded, between grid-type sections of the receiving structure; in other words they are configured as "positive forms". In particular it can be expedient if such arrangement directions are injection molded as a single piece onto grid sections of the base structure of the respective receiving structure and are disposed in particular in gaps in the grid structure of the base of the receiving structure, in other words the arrangement directions, in particular image symbols for the accommodation of items to be washed in the correct location and/or correct orientation, are positioned in each instance in gaps between the grid sections of the base structure. This allows liquid to flow, in particular be injected, largely freely between the free spaces between the respective arrangement direction element and web elements of the grid base of the receiving structure. The injection molded parts here can optionally be expediently configured thinly so that when there are a number of arrangement direction elements disposed next to one another in a group, wash liquor can also pass—in particular from bottom to top (and/or conversely from top to bottom) through the free spaces between the individual injection molded arrangement direction elements, in particular symbols. The passage of wash liquid, in other words wash liquor, and therefore the cleaning operation, is therefore not impeded with this configuration either.

It is advantageously also possible for the one or more arrangement directions to be provided at least partially with images that indicate a movable segment of the receiving structure. In particular such a specific image as for example the image of an espresso cup on a support and/or holding region, in other words a segment of the receiving structure, can indicate that when said segment is moved, there is space for other items to be washed (in this instance cups).

A receiving structure for items to be washed within a dishwasher, in particular a flat drawer for the holding and/or positioning of items to be washed, in particular flatware items or other, preferably small, items to be washed, with which one or more arrangement directions for the items to be washed that are to be held and/or positioned there are disposed on the receiving structure, can be sold separately, even as a replacement part or value-adding upgrade, and is claimed separately here.

Other advantageous developments of the invention are set out in the subclaims.

The advantageous configurations and developments of the invention described above and/or set out in the subclaims can be used individually or in any combination with one another here—except for example in instances of obvious dependencies or incompatible alternatives.

BRIEF DESCRIPTION OF THE DRAWINGS

The invention and its advantageous configurations and developments as well as their advantages are described in more detail below with reference to drawings showing schematic basic outlines, in which.

DETAILED DESCRIPTION OF EXEMPLARY EMBODIMENTS OF THE PRESENT INVENTION

Figure 1:
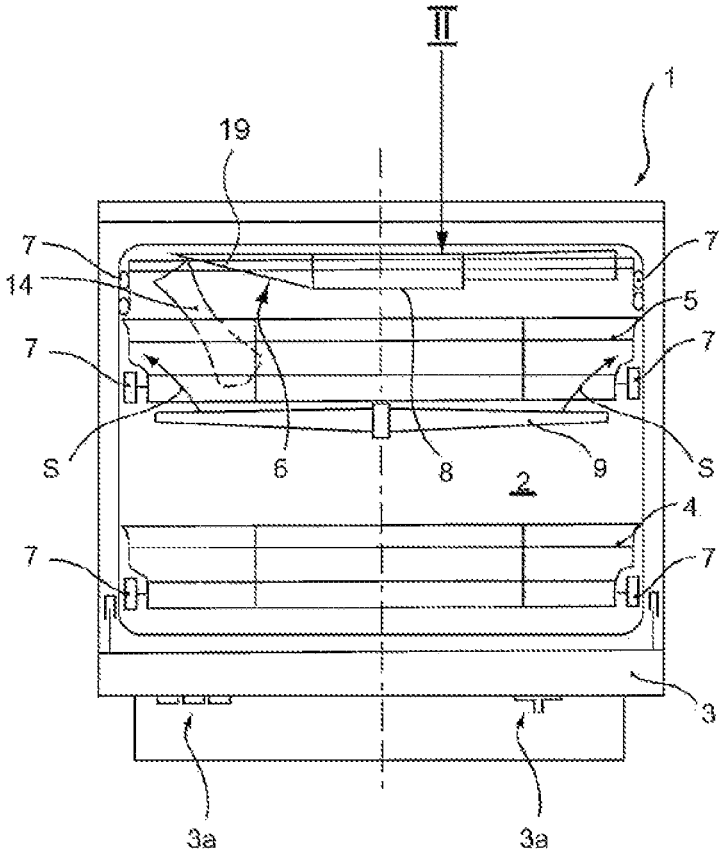
FIG. 1 shows a schematic view from the front of a dishwasher with a door that has been pivoted down and lies horizontally as well as with by way of example three receiving structures one above the other the topmost one of which is configured as a so-called flatware drawer.

In the figures which follow corresponding parts with the same function and mode of operation are shown with the same reference characters. Only those components of a dishwasher that are necessary for an understanding of the invention are provided with reference characters. It goes without saying that the inventive dishwasher can comprise further parts and assemblies.

The dishwasher 1 shown schematically in FIG. 1 is a domestic dishwasher and has a wash container 2 for receiving items to be washed or processed such as tableware, pots, flatware, glasses, cooking utensils and the like. The wash container 2 can have an at least essentially rectangular outline with a front face that faces a user in the operating position.

The wash container 2 can be closed off in particular at its front face V by a door 3. This door 3 is shown in the opened position in FIG. 1 (front view) and is pivoted forward and down for example about a bottom horizontal axis, so that the operating elements 3*a* face in a downward direction. An opening movement other than pivoting about a horizontal axis is also possible.

The wash container 2 is provided with a number of receiving structures 4, 5, 6 for holding tableware, flatware or similar items to be cleaned, which are disposed one above the other here and can be displaced in a forward direction in each instance by way of rollers 7 or the like for easier loading and unloading.

The upper receiving structure 6 is only configured here by way of example as a flat structural unit, in particular as a so-called flatware drawer for holding preferably small items to be washed, in particular flatware items. The receiving structure 6 comprises a grid-type, in some instances multiple-staged, base region 8. This allows wash liquid or wash liquor S from an upward acting spray arm 9 to exercise a washing action through the base region 8. Additionally or alternatively a top spray attached to the top wall of the wash container for example can act on items to be washed that are held in the receiving structure 6 from above. This is not shown here in FIG. 1 for the sake of the clarity of the drawing.

Arrangement directions 10, 11, 10*a*, 11*a*, 12*a*, 10*b*, 11*b*, 12*b* for items to be washed that are to be held there are disposed on at least one of the receiving structures 4, 5, 6 here.

Figure 2:
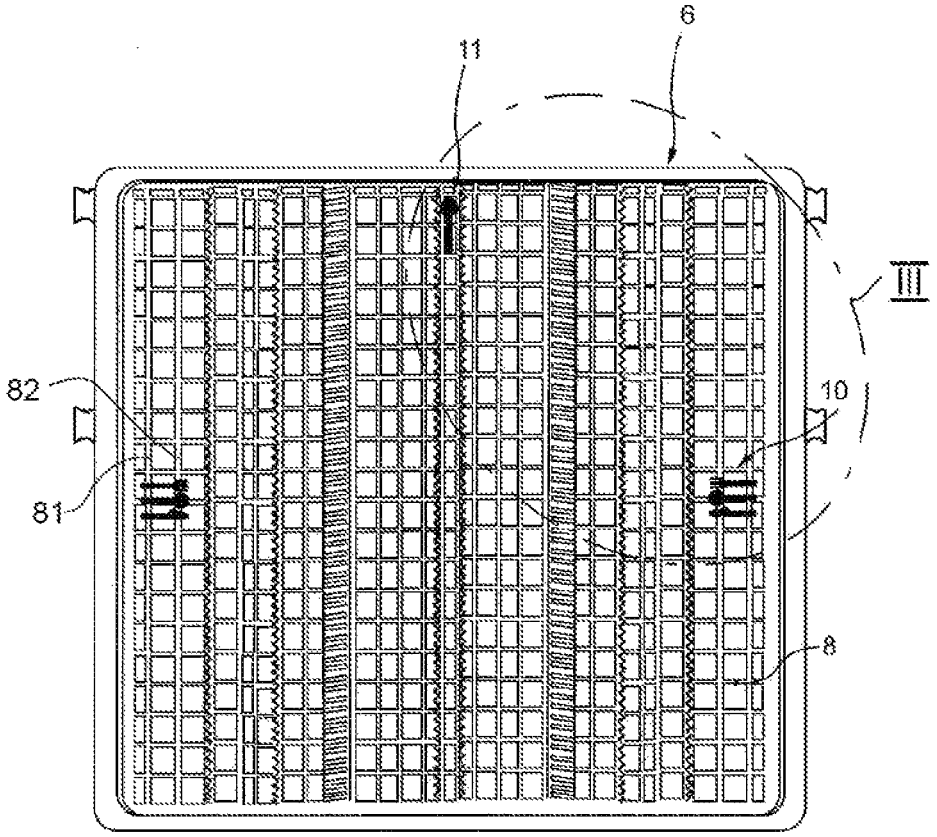
FIG. 2 shows a top view of a possible advantageous embodiment of the, in this instance upper, receiving structure, roughly from the direction of the arrow II in FIG. 1, according to the inventive construction principle.

As shown here in the figures, the arrangement directions 10, 11, 10*a*, 11*a*, 12*a*, 10*b*, 11*b*, 12*b* can comprise pictorial symbols or icons of the items to be washed that are to be held there, in particular flatware items, for example the symbol 10 shown in FIG. 2 for knives, forks and spoons or the symbol 11 shown there for a ladle.

The arrangement directions 10, 11, 10*a*, 11*a*, 12*a*, 10*b*, 11*b*, 12*b* here can indicate not only the respective target location region provided specifically for the flatware items but also or independently thereof a target orientation of items to be washed that are to be held and/or positioned there, as shown for example in FIG. 2. This is useful in particular if the base region 8 does not run isotropically but regions thereof are angled for example, in particular due to a correspondingly movably configured positioning and/or holding region of the receiving structure 6, as shown in the left region of FIG. 1, so that a tall glass 14 can be positioned there below the angled positioning and/or holding region 20.

The arrangement directions 10, 11, 10*a*, 11*a*, 12*a*, 10*b*, 11*b*, 12*b* here each show a two-dimensional or three-dimensional image of a spoon, fork and/or knife or a similar item to be washed, in particular a flatware setting item, for example a ladle, so that optimum loading is also clear for non-experts.

In the exemplary embodiments illustrated here the arrangement directions 10, 11, 10*a*, 11*a*, 12*a*, 10*b*, 11*b*, 12*b* are assigned at least partially to an in particular perforated base region 8 of the respective receiving structure—here the flatware drawer 6—and are visible from above. The perforated base region 8 in the exemplary embodiment here has a plurality of essentially square-shaped, preferably rectangle-shaped holes, with the respective hole being formed between four crossing points of intersecting longitudinal and transverse webs of the base region 8 of the receiving structure. Other geometric forms are of course also possible for the holes. An arrangement of the one or more arrangement directions on a peripheral edge and/or at least one vertical web region of the receiving structure can be additionally or alternatively useful, in particular if the dishwasher is in a higher position, in particular built in.

Figure 3:
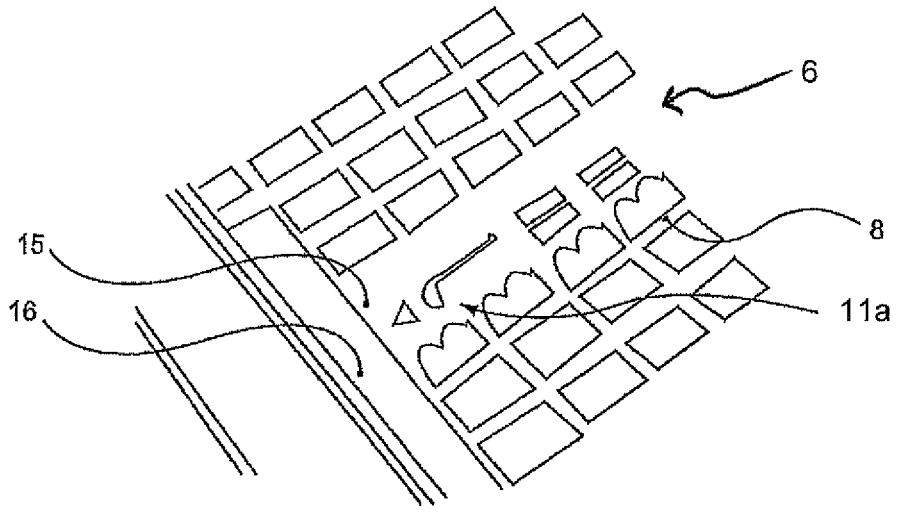
FIG. 3 shows a perspective view of a subregion of the receiving structure, roughly corresponding to the segment III in FIG. 2.

The arrangement directions 10, 11 illustrated in the exemplary embodiment according to FIGS. 2 and 3 rest in the form of fixed, in particular injection molded, parts on the grid base 8, for example in the form of metal or plastic parts. They can then advantageously be configured in particular from the same material and as a single piece together with the base 8. The individual symbol elements for the items to be washed that are to be introduced, in particular flatware items, such as here for example the miniature symbols for knives, forks, spoons, ladles, are preferably positioned on the grid base 8 in such a manner that sufficient space remains for the passage of wash liquor between them and/or from adjacent webs of the grid base, so the symbols do not block such passage.

In particular it can be expedient if the symbol elements are positioned in a fixed manner, in particular injection molded, onto two adjacent webs of the grid base 8 that run roughly parallel and with a transverse gap, in other words free space, between them. The respective symbol element is expediently positioned in a fixed manner, in particular injection molded, at one end in particular on the upper face of a first web, for example 81, and at the other end in particular on the upper face of a second web, for example 82, of the grid base 8. This fixed connection of opposing ends of the respective arrangement direction element on webs of the receiving structure favorably results in a secure positioning of the respective arrangement direction element on the receiving structure, so that damage to or even the tearing off of the respective arrangement direction element from the receiving structure is largely avoided when the dishwasher is in use. In particular if the respective arrangement direction element is positioned on the upper faces of the webs of the grid base, it can be produced in a structurally simple manner together with the receiving structure in the same operation, as the upper face of the grid base is freely accessible. The positioning of the respective arrangement direction element on an upper face also avoids connecting regions with the webs of the grid base 8, in which drops of liquid and/or dirt particles could collect. A free discharge of wash liquid in a downward direction is also ensured, so that reliable drying of the receiving structure is ensured during the drying cycle of a dishwashing program to be performed.

It can be advantageous in particular if with this variant the respective arrangement direction element is configured with a three-dimensional geometric form in order to increase the plasticity of the symbol so that the representation of the item to be washed, in particular flatware item, that is to be positioned and/or stored in each instance is as representative and true to reality as possible. The ability of liquid to drip off the respective arrangement direction element is also increased compared with a just two-dimensional form of the respective arrangement direction element.

In order to keep the receiving structure, in particular the flatware drawer 6, as flat as possible, to avoid restricting the useful height, the arrangement directions 10*a*, 11*a*, 12*a*, 10*b*, 11*b*, 12*b* are expediently assigned to the base region of the receiving structure 6 in such a manner that they do not extend beyond its thickness in a vertical direction.

Figure 4:
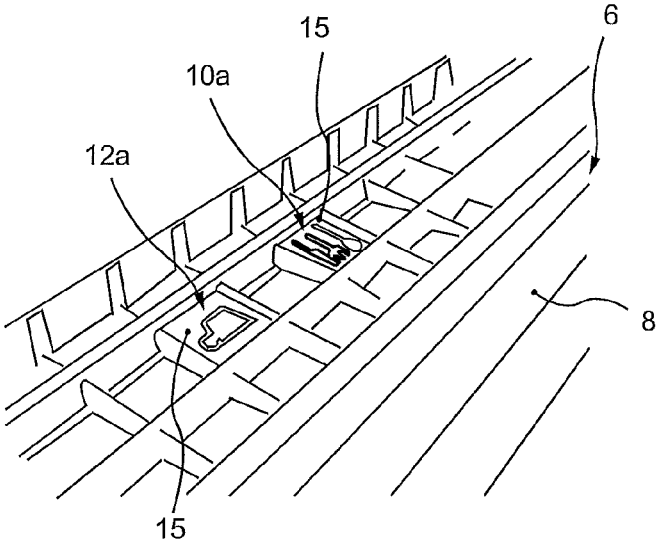
FIG. 4 shows a similar view to FIG. 3 but of an alternative advantageous embodiment with symbols removed, for example stamped out, from of a surface.
Figure 5:
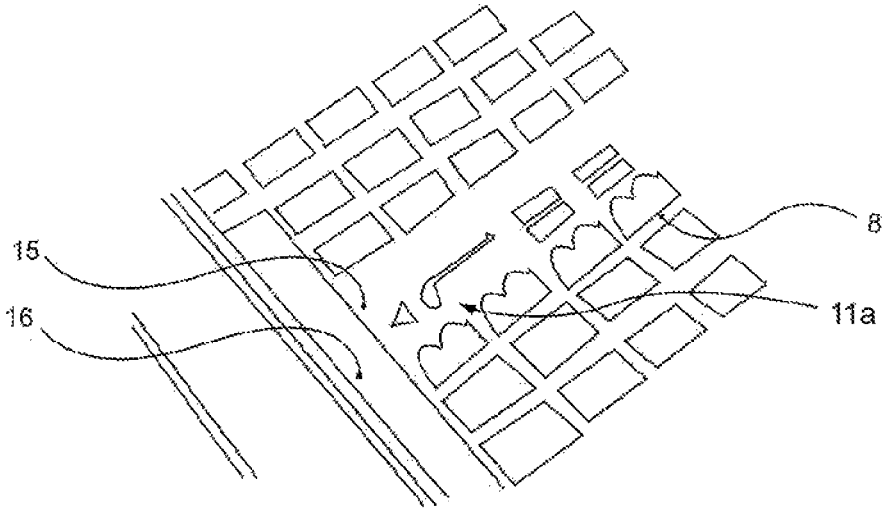
FIG. 5 shows a region of the grid base, in which the symbol for a ladle and its target orientation shown by an arrow head are stamped.

For example the arrangement directions 10*a*, 11*a*, 12*a* can be configured, as in FIGS. 4 and 5, at least partially as negative images removed, in particular cut out or stamped out, from flat regions 15 in the base 8 of the receiving structure 4, 5, 6. The respective base surface element, from which the contour of the respective image symbol is removed, in particular stamped out or cut out, to leave a hole, is preferably disposed expediently in a roughly square, preferably rectangular, field, which is disposed between four crossing points of transverse and longitudinal webs of the grid base 8. It is preferably located in the region of the outer edge of the receiving structure. These negative images, which are provided on different positioning regions of the grid base, allow these to be identified as specific positioning regions for particular types of item to be washed. Also these negative image cutouts can indicate or mark the insertion direction for the items to be washed that are to be positioned there, in particular flatware items. The negative cutting out of the image symbols from a flat material surface means that the arrangement direction elements are configured in a flat, in particular essentially planar, manner here so they have a two-dimensional geometric form. The symbol 12*a* of the ladle here is configured with multiple parts and comprises not only the flatware symbol but also a direction arrow, to show that a widening or a larger gap 16 than the square-shaped holes between the intersecting webs of the grid base 8 is provided below in the grid base 8 for the scoop region of any ladle to be introduced. All these stamps or cutouts allow wash liquor to pass through the peripheral gaps of the respectively stamped or cut out image (knife, fork, spoon, ladle, cup). This also means that flatware items for example can be wet by a spray arm acting from below; also the discharge of wash liquor in a downward direction is not impeded by such stamps 10*a*, 11*a*, 12*a*.

Figure 6:
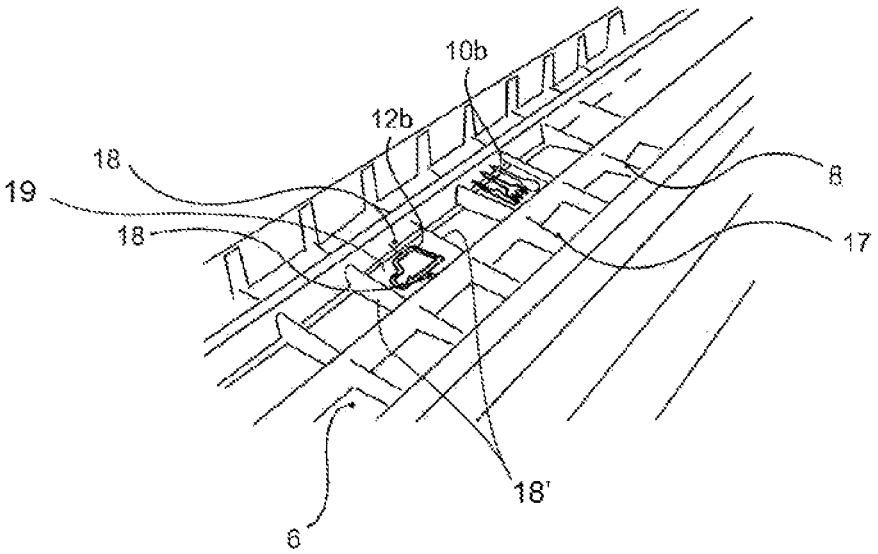
FIG. 6 shows a similar view to FIG. 3 but of an alternative advantageous embodiment with symbols injection molded onto web regions of the receiving structure.
Figure 7:
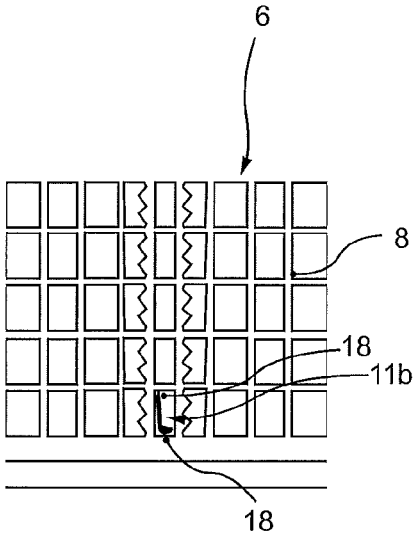
FIG. 7 shows a region of the grid base of a receiving structure, where the symbol for a ladle and/or its orientation shown by an arrow head are injection molded in a gap between webs of the grid base.

In the alternative configuration according to FIGS. 6 and 7—in an inversion of the exemplary embodiment in FIGS. 4 and 5—the arrangement directions 10*b*, 11*b*, 12*b* are configured at least partially as here in particular two-dimensional, flat plastic symbols injection molded between grid-type sections 17 of the base 8 of the receiving structure 6 and in holes or gaps 19 between said grid-type sections 17, which are formed here in the exemplary embodiment in particular by intersecting webs 18, 18' at a distance from one another in the longitudinal and transverse directions of the receiving structure. The symbols here are preferably each only connected at one end to a web, for example 18, of the grid base 8 and therefore project freely into a gap 19 in the grid base 8. This means that a passage of wash liquor is also not prevented here, either upward or downward, by the symbols, as enough free space remains for the passage of wash liquid at the sides and/or between the free end of the respective symbol and the respective opposing web of the grid base.

To summarize, with the two advantageous variants in FIGS. 2, 3 and 6, 7 the arrangement direction elements, for example 10, 11 and 10*b*, 11*b*, 12*b*, are produced with positive forms while the arrangement direction elements, for example 10*a*, 11*a*, 12*a* of the advantageous modified variant in FIGS. 4, 5 are formed by negative forms. The latter can be produced particularly simply from a manufacturing point of view, in particular by stamping, which is particularly favorable for mass production. In the case of negative forms wash liquid can pass freely through their openings. In the case of positive forms these are expediently disposed in such a manner that wash liquid can flow around the respective positive form. In neither instance is liquid blocked, as with a completely closed surface, but unlike with a full surface cover liquid can also pass sufficiently freely through the base of the receiving structure even at the site of the respective arrangement direction element.

A mixture of different embodiments is also possible. Also the arrangement direction elements, in particular symbols, can also be colored or even contrasted in color with the surrounding base region. In particular an arrangement direction for the visualization of the ability of a holding and/or positioning region to be moved and/or modified can be identified by a characteristic coloring, which is different from the color of the other regions of the receiving structure. Also as an alternative or in addition to the fixing shown here retaining clamps or similar can be provided with such arrangement directions for detachable fixing, in particular to allow the upgrading of existing dishwashers. In addition or independently of the positioning of one or more arrangement directions on or in one or more base regions of the receiving structure one or more arrangement directions can optionally also be positioned on one or more segments of the outer support frame or other structural parts of the respective receiving structure.

If the arrangement directions 12*a*, 12*b* are provided at least partially with images 12*a*, 12*b* that indicate a flexibly movable segment of the receiving structure, for example the image of an espresso cup shown here, it can be shown that a movable region (which can be folded up or removed for example) is present, which opens up possibilities for example for the suspension of cups.

In the exemplary embodiments the arrangement directions 10, 11, 10*a*, 11*a*, 12*a*, 10*b*, 11*b*, 12*b* are only assigned to the flat drawer 6 for holding small items to be washed, in particular flatware items. This is not mandatory but arrangement directions 10, 11, 10*a*, 11*a*, 12*a*, 10*b*, 11*b*, 12*b* can also be disposed on each of the receiving structure 4, 5, 6 for the items to be washed that are to be held there, in particular with pictorial symbols of the items to be washed that are to be held there and in particular with an indication of the target orientation of items to be washed that are to be held there.

Further symbols for further items to be washed are of course also possible in addition to the miniature symbols shown here.

The invention claimed is:

1. A dishwasher for cleaning an item to be washed, comprising:

at least one receiving structure configured to hold the item to be washed in a target location, and at least one arrangement direction disposed on the at least one receiving structure, the at least one arrangement direction comprising an icon that is shaped as a miniaturized symbolic version representative of the item to be washed, the icon being separate from the target location and structured and positioned to indicate the target location and/or a target orientation where the item to be washed is to be placed in the at least one receiving structure, wherein the icon is configured at least partially as a two dimensional image removed from a flat region of a base of the receiving structure, the two dimensional image allowing washing liquor to pass therethrough during operation of the dishwasher, and wherein the icon is not structured to support the item to be washed and is visible from above even after the item to be washed is loaded onto the receiving structure.

2. The dishwasher of claim 1, constructed in the form of a domestic dishwasher.

3. The dishwasher of claim 1, wherein the at least one receiving structure is configured as a drawer constructed for displacement in a forward direction for loading and unloading purposes.

4. The dishwasher of claim 1, wherein the at least one arrangement direction indicates a target location and a target orientation for the item to be washed.

5. The dishwasher of claim 1, wherein the item is a flatware item selected from the group consisting of a spoon, fork, knife, and ladle, or a tableware item.

6. The dishwasher of claim 1, wherein the at least one arrangement direction is assigned at least partially to a region of the receiving structure so as to be visible from above.

7. The dishwasher of claim 6, wherein the region of the receiving structure is a perforated base region of the receiving structure.

8. The dishwasher of claim 6, wherein the at least one arrangement direction is sized so as to be prevented from extending beyond a thickness of the receiving structure in a vertical direction.

9. The dishwasher of claim 1, wherein the at least one arrangement direction is attached on an upper face of a web of the base of the receiving structure.

10. The dishwasher of claim 9, wherein the at least one arrangement direction is molded onto the upper face of the web of the grid base of the receiving structure.

11. The dishwasher of claim 9, wherein the at least one arrangement direction is provided at least partially with an image that indicates a flexibly movable segment of the receiving structure.

12. The dishwasher of claim 1, wherein the image is of an espresso cup.

13. The receiving structure of claim 1, wherein the at least one arrangement direction is shaped to resemble the item to be washed.

14. A receiving structure for an item to be washed that is to be held and/or positioned within a dishwasher in a target location, comprising at least one arrangement direction for the item to be washed, said arrangement direction being disposed on the receiving structure, the at least one arrangement direction comprising an icon that is shaped as a miniaturized symbolic version representative of the item to be washed, the icon being separate from the target location and structured and positioned to indicate the target location and/or a target orientation where the item to be washed is to be placed in the at least one receiving structure, wherein the icon is configured at least partially as a two dimensional image removed from a flat region of a base of the receiving structure, the two dimensional image allowing washing liquor to pass therethrough during operation of the dishwasher, and wherein the icon is not structured to support the item to be washed and is visible from above even after the item to be washed is loaded onto the receiving structure.

15. The receiving structure of claim 14, wherein the at least one arrangement direction indicates the target location and the target orientation for the item to be washed.

* * * * *